US008640404B2

(12) United States Patent
McCool

(10) Patent No.: US 8,640,404 B2
(45) Date of Patent: Feb. 4, 2014

(54) HARDWOOD STAIR TREAD OVERLAY

(76) Inventor: James M. McCool, Columbus, OH (US)

( * ) Notice: Subject to any disclaimer, the term of this patent is extended or adjusted under 35 U.S.C. 154(b) by 547 days.

(21) Appl. No.: 12/436,378

(22) Filed: May 6, 2009

(65) Prior Publication Data

US 2009/0277104 A1 Nov. 12, 2009

Related U.S. Application Data

(60) Provisional application No. 61/050,636, filed on May 6, 2008.

(51) Int. Cl.
*E04F 11/16* (2006.01)

(52) U.S. Cl.
USPC ..... 52/179; 52/188

(58) Field of Classification Search
USPC ..... 52/179, 177, 182, 184, 188, 191, 741.2
See application file for complete search history.

(56) References Cited

U.S. PATENT DOCUMENTS 606,532 A * 6/1898 Furness ..... 52/179
989,409 A * 4/1911 Perrott ..... 52/179
2,236,465 A * 3/1941 Carlson ..... 52/179
2,436,139 A * 2/1948 James ..... 52/179
5,531,048 A * 7/1996 Darling ..... 52/188
6,067,758 A * 5/2000 Zenkner ..... 52/182
6,088,976 A * 7/2000 Roy ..... 52/179
6,115,975 A * 9/2000 Abdollahi ..... 52/179
6,397,529 B1 * 6/2002 Grenier ..... 52/182
6,438,909 B2 * 8/2002 Birch et al. ..... 52/182
2006/0230224 A1 * 10/2006 Yamazaki et al. ..... 711/100
2006/0230693 A1 * 10/2006 Giordano ..... 52/182
2006/0260224 A1 * 11/2006 Grenier ..... 52/182
2008/0028699 A1 * 2/2008 Mak ..... 52/179
2008/0295422 A1 * 12/2008 Neuhofer, Jr. ..... 52/179

* cited by examiner

*Primary Examiner* — Branon Painter
(74) *Attorney, Agent, or Firm* — Attentive Law; Robert Ratcliffe

(57) ABSTRACT

A stair tread overlay and a riser overlay made from solid wood for fitting over a conventional, exposed wooden stair having a generally rounded nose like those found in most residential general construction staircases and prefabricated staircases. The tread overlay and riser overlay cover the exterior surface of a conventional wooden stair from stringer to stringer to hide a construction grade stair tread and riser below that are made from a composite material or unsalvageable hardwood to present an attractive, solid wood surface that is finishable.

15 Claims, 4 Drawing Sheets

HARDWOOD STAIR TREAD OVERLAY

CROSS-REFERENCES TO RELATED APPLICATIONS

This application claims the benefit of U.S. Provisional Application No. 61/050,636 filed May 6, 2008.

STATEMENT REGARDING FEDERALLY-SPONSORED RESEARCH AND DEVELOPMENT (Not Applicable)

REFERENCE TO AN APPENDIX (Not Applicable)

BACKGROUND OF THE INVENTION

1. Field Of The Invention

This invention relates generally to the field of staircase repair and restoration and relates more particularly to hardwood overlays for covering an existing composite or solid wood staircase and a method of installing the same.

2. Description Of The Related Art

Conventional staircases of the type found in many residential buildings are commonly fabricated from raw, construction grade materials, such as plywood, fiberboard or various other composites, and are covered with flooring materials such as carpeting to provide an attractive and comfortable exterior surface. It is also relatively common for residential staircases to be fabricated from solid hardwood, such as oak, walnut, or cherry. Hardwood staircases are generally more desirable than carpeted composite staircases and are more expensive to construct due to the higher cost of the materials involved.

In the case of carpeted staircases, it is sometimes desirable to upgrade the staircase to a solid hardwood staircase for aesthetic reasons, such as when the seller of a home wishes to make the home more attractive to potential buyers, even when the original carpeted staircase is in good condition. In the case of hardwood staircases, the accumulation of surface wear over the course of time can make replacement of the staircase desirable, and sometimes even necessary, for aesthetic and functional reasons. In either case, replacing an existing staircase with a new, solid hardwood staircase typically requires extensive demolition and can sometimes be prohibitively expensive.

It would therefore be advantageous to have a means for achieving the appearance, durability, and longevity of a brand new, solid hardwood staircase without having to demolish an existing hardwood or carpeted composite staircase. It would further be advantageous to have such a means that is affordable and that can be implemented quickly and easily.

BRIEF SUMMARY OF THE INVENTION

In accordance with the present invention, there is provided a stair tread overlay and a riser overlay that are made from solid wood and that are milled and cut to fit over a conventional, exposed wooden stair having a generally rounded nose like those found in most residential general construction staircases and prefabricated staircases. The tread overlay and riser overlay can cover a conventional wooden stair tread and riser completely from end to end (stringer to stringer) to hide a construction grade stair tread and riser (e.g., a stair tread and a riser that are made from plywood or another composite and that are typically covered with flooring material, such as carpeting) or an unsalvageable hardwood stair tread and riser to present an attractive, solid wood surface that is finishable. The tread overlay and riser overlay can also be used to cover a tread and riser only at the longitudinal ends of the tread and riser, against the abutting stringers of the staircase, to provide a finished hardwood surface at each end of the tread and riser in order to facilitate the installation of a carpet type runner in the middle of the staircase.

The profile of the tread overlay is preferably J-shaped and conforms to the shape of a conventional wooden stair tread profile having a rounded front edge. The overlay is formed with a length and a depth that are greater than that of a standard tread for allowing the overlay to be trimmed to size for accommodating a variety of standard and non-standard applications. The overlay can be milled and/or carved to allow fitment over multiple tread thicknesses. The overlay is affixed to an existing tread by using any conventional wood-to-wood adhesive, although it is contemplated that any other fastener for mounting the overlay to an existing tread, such as nails or screws, can also be used.

The tread overlay and riser overlay are preferably each formed of a single piece of solid hardwood material with an exterior surface that is finishable for accepting a desired stain color and/or finish coat. It is contemplated, however, that the overlay can be formed of multiple pieces of wood that are fit together. The overlays can be finished prior to installation (prefinished) or finished after installation (site finished).

The invention thus provides an alternative means of converting wooden staircases made from construction grade materials (solid or composite) or unsalvageable hardwood staircases into substantially new-looking solid hardwood staircases. The invention simplifies the task of conversion by eliminating the need to demolish, modify, and/or reconstruct the existing staircase as is typical with current methods for achieving hardwood conversion. Applying the tread overlays and riser overlays of the present invention to an existing staircase provides the staircase with an exterior surface that is consistent with most characteristics of a conventional solid hardwood staircase. The overlays achieve the beauty, durability and longevity that solid wood provides. Because the overlays are made of solid hardwood and have a substantial thickness, they are sandable and refinishable.

Figure 1:
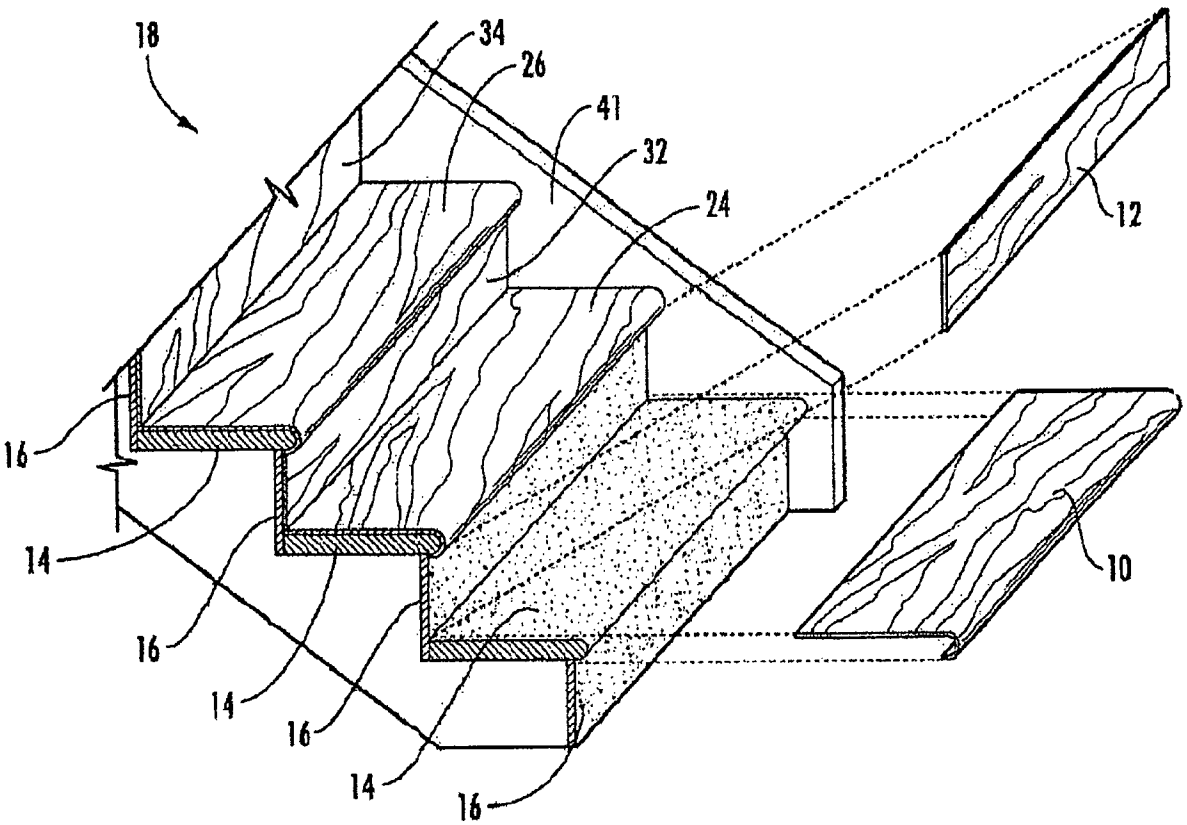
FIG. 1 is a perspective exploded view in section illustrating the preferred embodiment of the present invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

Figure 2:
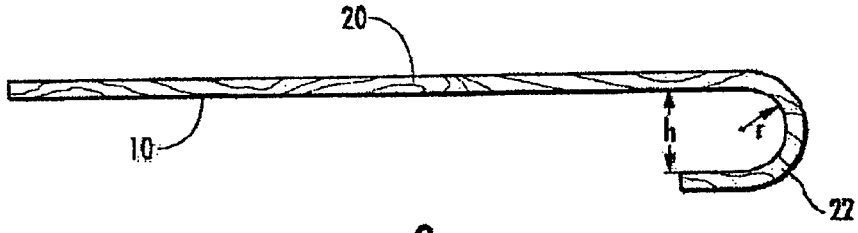
FIG. 2 is a side view illustrating the tread overlay of the preferred embodiment of the present invention shown in FIG. 1.
Figure 3:
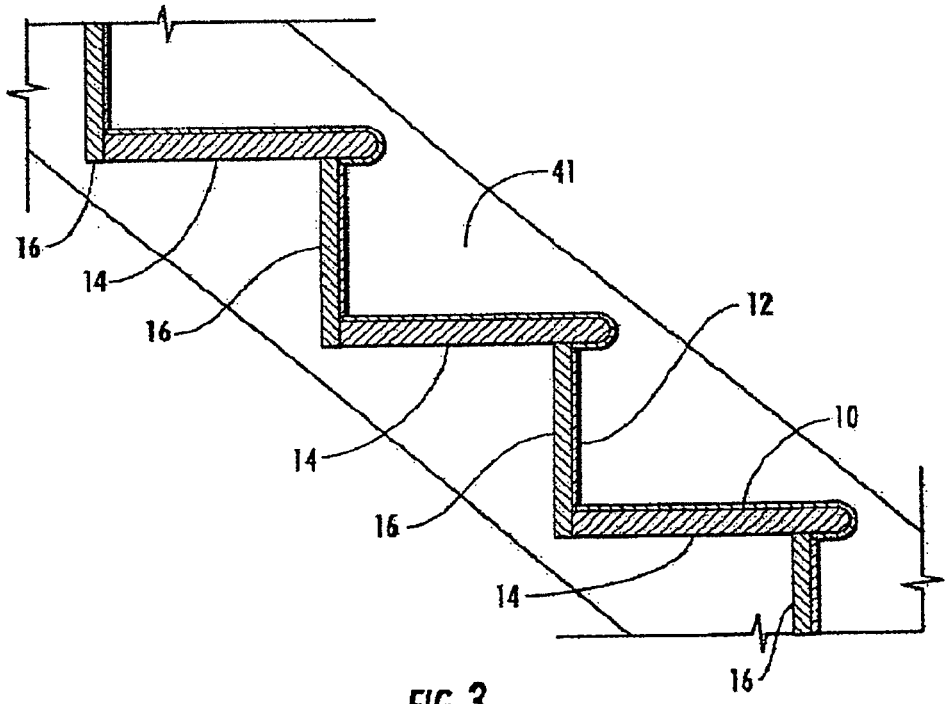
FIG. 3 is a side view in section illustrating the preferred embodiment of the present invention.

Referring to FIGS. 1-3, a stair tread overlay 10 and a riser overlay 12 for fitting over the treads 14 and risers 16 of a prefabricated composite or solid wood staircase 18 are shown. Both the tread overlay 10 and the riser overlay 12 are fabricated from solid oak, although it is contemplated that the tread overlay 10 and the riser overlay 12 can alternatively be fabricated from the wood of any non-monocot angiosperm tree (i.e., hardwood), including, but not limited to walnut, ash, cherry, and hickory. It is further contemplated that the tread overlay 10 and riser overlay 12 can be fabricated from the wood of any coniferous tree (i.e., softwood), including, but not limited to cedar, pine, and spruce, although hardwoods are generally preferred over softwoods for their superior durability.

The tread overlay 10 is preferably milled from a solid piece of hardwood and is defined by a planar tread portion 20 (see FIG. 2) and a rounded nose portion 22, although it is contemplated that the tread overlay 10 can be formed of two or more separate pieces of wood that are mounted to one another, such as with conventional fasteners or adhesives. For example, an equivalent tread overlay can be made of a separate planar panel and a curved piece that are glued together when installed. Referring to FIG. 2, the tread overlay has a J-shaped profile with a uniform thickness of ⅜ inches, although it is contemplated that tread overlay 10 can have any thickness in a range of about 0.05 inches to about 1 inch. It is further contemplated that the thickness of the tread overlay 10 can be non-uniform, for example to accommodate an underlying obstruction.

The nose portion 22 of the tread overlay has an interior height, h of 1.5 inches and an interior radius, r of 0.75 inches for fitting over the nosing of most standard size stair treads (as will be described in greater detail below), although it is contemplated that the interior height, h and interior radius, r of the tread overlay 10 can be varied to conform to the size and shape of any stair tread that is to be covered. It is further contemplated that the nose portion 22 of the tread overlay can have a variety of other profile shapes, such as rectangular or triangular, for conforming to an existing stair tread that is not rounded. Still further, it is contemplated that the nose portion 22 of the tread overlay can have an interior profile shape that conforms to the nose shape of a stair tread to be covered but an exterior profile shape that is different than the nose shape of the stair tread to be covered. For example, it is contemplated that the nose portion 22 of the tread overlay 10 can have a rounded interior profile shape for fitting over the rounded nose of an underlying stair tread and a square exterior profile shape for providing the underlying staircase with a new and different exterior shape. Still further, it is contemplated that voids can exist if the interior profile shape does not precisely conform to the exterior shape of the stair tread.

Referring to FIG. 1, the tread overlay 10 and a plurality of similar tread overlays 24 and 26 that are intended to cover the stair treads 14 of the same existing composite or unsalvageable solid wood staircase 18 are preferably fabricated with a uniform width and a uniform depth that are greater than the width and the depth of the stair treads 14 that are to be covered. The tread overlays 10, 24, and 26 can therefore be individually trimmed down to a necessary width and depth on-site, such as with a table saw or a circular saw. This allows precise custom fitting of the tread overlays 10, 24, and 26 for each of the individual stair treads 14 in the existing staircase 18, some of which may have been built with intended or unintended variances in size or which may have shifted or been repaired over time. For example, for covering most standard size stair treads having a width of 3.5 feet and a depth of 10 inches, the tread overlays 10, 24, and 26 are preferably fabricated with a width of 4 feet and a depth of 12 inches. Alternatively, it is contemplated that the treads 14 on the existing staircase 18 can be individually measured and that each individual tread overlay 10, 24, and 26 can be fabricated with dimensions matching a specific premeasured tread 14 to achieve a proper fit thereon.

Still referring to FIG. 1, the riser overlay 12 is an elongated rectangular panel that is preferably cut from a single piece of hardwood, although it is contemplated that the riser overlay 12 can be formed of two or more separate pieces of wood that are mounted to one another, such as with conventional fasteners or adhesives. The riser overlay 12 has a uniform thickness of ⅜ inches, although it is contemplated that riser overlay 12 can have any thickness in a range of about 0.05 inches to about 1 inch. It is further contemplated that the thickness of the riser overlay 12 can be non-uniform. Still further, it is contemplated that the riser overlay 12 can have any shape other than rectangular, such as triangular or trapezoidal, for conforming to the shape of a particular riser that is to be covered.

As with the stair tread overlays 10, 24, and 26 described above, the riser overlay 10 and a plurality of similar riser overlays 32 and 34 that are intended to cover the risers 16 of the same existing staircase 18 are preferably fabricated with a uniform width and a uniform height that are greater than the width and the height of the risers 16 that are to be covered. The riser overlays 12, 32, and 34 can therefore be individually trimmed to a necessary width and height on-site, such as with a table saw or a circular saw, to allow precise custom fitting of the riser overlays 12, 32, and 34 for each of the individual risers 16 in the existing staircase 18, some of which may have been built with intended or unintended variances in size. For example, for covering most standard size stair risers having a width of 3.5 feet and a height of 7 inches, the riser overlays 12, 32, and 34 are preferably fabricated with a width of 4 feet and a height of 8 inches. Alternatively, it is contemplated that the risers 16 on the existing staircase 18 can be individually measured and that each individual riser overlay 12, 32, and 34 can be fabricated with dimensions matching a specific premeasured riser 16 to achieve a proper fit thereon.

In order to install the tread overlays 10, 24, and 26 and the riser overlays 12, 32, and 34 on an existing composite or unsalvageable hardwood staircase, such as the staircase 18 in FIG. 1, an installer first measures the width and depth of the existing staircase's treads 14 and the width and height of the existing staircase's risers 16. If the existing treads 14 and risers 16 are obviously of uniform size, the installer will generally only need to measure the tread and riser of a single stair, otherwise the installer will have to measure each tread and riser that differs in size.

Next, the tread overlays 10, 24, and 26 and the riser overlays 12, 32, and 34 of the present invention, which are fabricated with dimensions larger than those of the existing treads 14 and risers 16 (as described above), are cut down to the measured sizes of the existing treads 14 and risers 16 on-site. For example, the tread overlays 10, 24, and 26 are cut longitudinally and laterally to reduce their depths and widths, respectively, to appropriate sizes. Similarly, the riser overlays 12, 32, and 34 are cut laterally to reduce their widths to appropriate sizes.

Finally, the cut tread overlays 10, 24, and 26 and cut riser overlays 12, 32, and 34 are firmly mounted to the treads 14 and risers 16 of the existing staircase with conventional wood-to-wood adhesive. Of course, it is contemplated that the tread overlays 10, 24, and 26 and riser overlays 12, 32, and 34 can be mounted to the treads 14 and risers 16 using any other suitable means of affixation, such as with conventional fasteners or with other types of adhesives. The surfaces of the tread overlays 10, 24, and 26 and riser overlays 12, 32, and 34 that face and engage the existing treads 14 and risers 16 have a moderately rough texture for holding the adhesive to achieve proper adhesion. Such a surface texture can be achieved using any conventional means, such as by sanding or by the milling and cutting processes used to fabricate the overlays 10, 24, 26, 12, 32, and 34. In some cases, it may be beneficial or necessary to sand or otherwise distress the exterior surfaces of the existing stair treads 14 and risers 16 before mounting the overlays 10, 24, 26, 12, 32, and 34 in order to provide the treads 14 and risers 16 with a surface that is sufficiently rough to hold the adhesive.

Once installed, the tread overlays 10, 24, and 26 and riser overlays 12, 32, and 34 cover substantially all of the exterior surfaces of the treads 14 and risers 16 of the underlying staircase from stringer 41 to the other stringer (only the stringer 41 is shown in FIGS. 1 and 3). The tread overlays 10, 24, and 26 and riser overlays 12, 32, and 34 preferably have finishable exterior surfaces for accepting any desired stain color and/or finish coat, such as varnish or paint. It is contemplated that the overlays 10, 24, 26, 12, 32, and 34 can be finished prior to installation (prefinished) or finished after installation (site finished) as will be appreciated by those skilled in the art of flooring materials.

Figure 4:
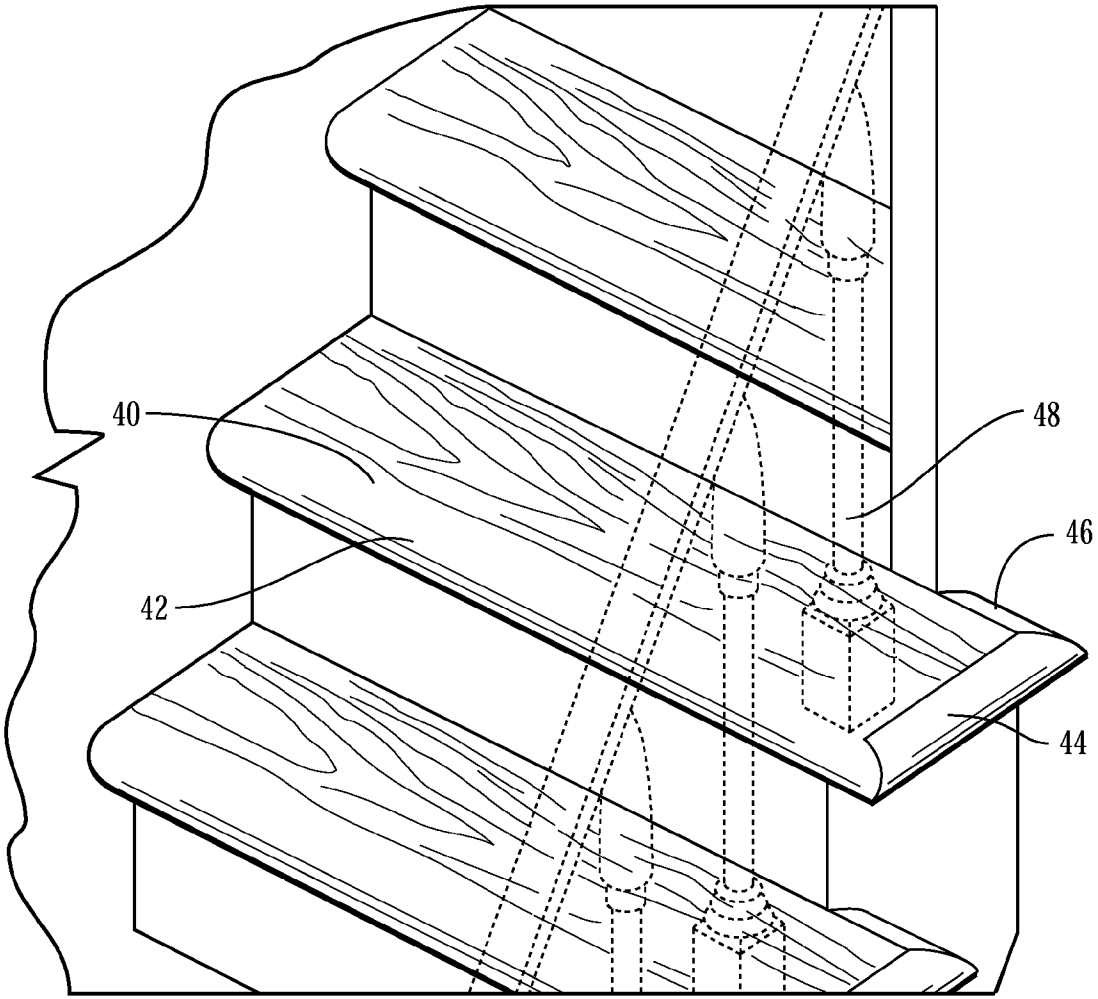
FIG. 4 is a perspective view illustrating a first alternative embodiment of the present invention.

Referring to FIG. 4, a first alternative embodiment of the inventive tread overlay, indicated generally at 40, is contemplated for fitting over an "open-ended" stair tread. An "open-ended" stair tread is defined herein as a stair tread having a first longitudinal end that abuts a conventional stringer and an opposite longitudinal end that extends into open space (i.e., does not abut a stringer in the same way). An open-ended tread therefore has three exposed edges (i.e., a front edge, a partially protruding rear edge, and a longitudinal edge) which is to be contrasted with the "closed-end" stair treads 14 described above which only have one exposed edge (i.e., a front edge).

The tread overlay 40 is similar to the tread overlay 10 described above with a first nose portion 42 extending from the front of the tread portion, but additionally includes a second, separate nose portion 44 adjoining the first nose portion 42 that extends from a longitudinal end of the tread portion and a third, separate nose portion 46 adjoining the second nose portion 44 that extends from the rear of the tread portion. When assembled together; the three nose portions 42, 44, and 46 cover all three exposed edges of the underlying open-ended tread. It is contemplated that the tread overlay 40 can alternatively be fabricated with a fourth adjoining nose portion (not pictured) extending from the opposite longitudinal end of the tread overlay 40 from the second nose portion 44 for covering a stair tread having two open longitudinal ends (i.e., a tread that does not abut a stringer at either longitudinal end). During installation, the tread overlay 40 is measured, cut, and mounted in a substantially similar manner to the tread overlay 10 described above. It should be noted that some open-ended staircases feature a banister, such as the banister 48, which generally must be removed before the overlay 40 is installed and can be replaced after installation is complete. Once the overlay 40 is installed, the nose portions 44 and 46 are trimmed and installed.

Figure 5:
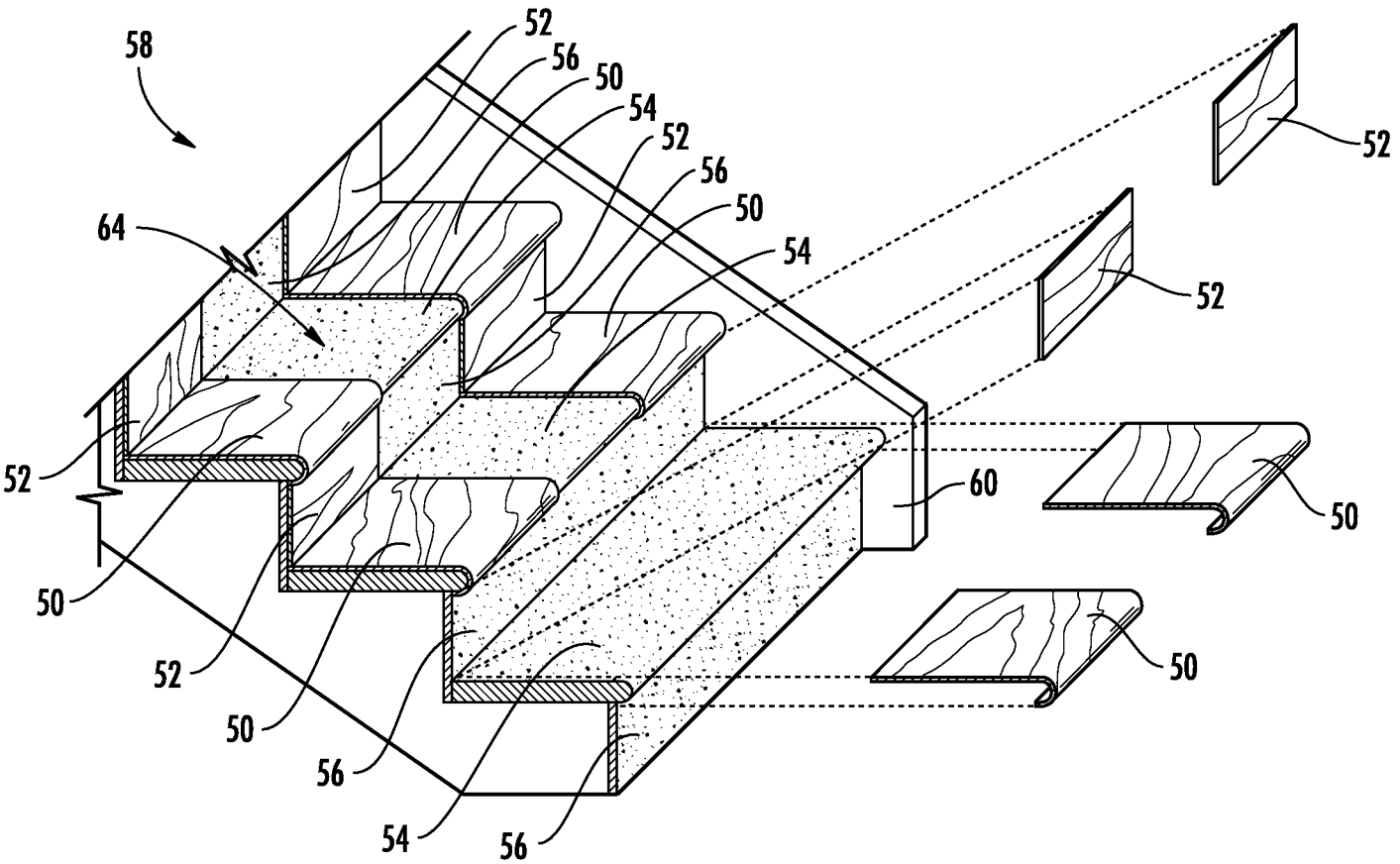
FIG. 5 is a perspective exploded view in section illustrating a second alternative embodiment of the present invention.

Referring to FIG. 5, a second alternative embodiment of the present invention is contemplated for accommodating the installation of a central runner made from a flooring material such as carpeting or tile on a staircase. In this embodiment, the tread overlays 50 and riser overlays 52 are similar to the tread overlay 10 and riser overlay 12 described above, except that each of the tread overlays 50 and riser overlays 52 has a width that is less than half the width of the stair treads 54 and risers 56 of the underlying staircase 58. The tread overlays 50 and riser overlays 52 are mounted over the opposing longitudinal ends of their respective stairs in abutment with the stringer 60 and the opposite stringer (only the stringer 60 is shown in FIG. 5). Each pair of tread overlays 50 and each pair of riser overlays 52 thus define an exposed central channel 64 in which flooring material, such as carpeting or tile, can be installed in a conventional manner in direct contact with the existing staircase 58 to provide the staircase 58 with a central runner. The flooring material of the runner thereby sits flush with the longitudinally-adjacent tread overlays 50 and riser overlays 52 and presents an attractive, uniform appearance.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A single-piece solid wood stair tread overlay for fitting over a stair tread having a nose, the tread overlay comprising an elongated, substantially planar top tread portion for fitting over a top planar portion of the stair tread, a non-planar nose portion extending from an edge of the top tread portion for fitting over the nose of the stair tread wherein the non-planar nose portion has an inner surface preformed in a concave shape, wherein the inner surface is formed by milling the nose portion of a solid wood piece comprising both the tread portion and the nose portion, and a substantially planar bottom tread portion extending from a bottom edge of the non-planar nose portion for fitting over a bottom planar portion of the stair tread.

2. The tread overlay in accordance with claim 1 wherein the nose portion of the tread overlay has a rounded outer surface.

3. The tread overlay in accordance with claim 1, wherein the distance between the inner surface of the top planar portion of the stair tread overlay and the inner surface of the bottom planar portion of the stair tread overlay is substantially equal to twice as much as the radius of the preformed concave inner surface of the non-planar nose of the tread.

4. The overlay of claim 1, wherein the solid wood piece can be formed of two or more separate pieces of wood mounted to one another.

5. A single-piece stair overlay system for fitting over a stair having a riser and a tread with a nose, an upper planar surface and a lower planar surface, the overlay system comprising:

a. a single-piece tread overlay having an upper elongated planar tread portion for fitting over a planar portion of the upper planar surface of the stair tread, a lower planar tread portion for fitting wider a planar portion of the lower planar surface of the stair tread, and a non-planar nose portion extending from an edge of the upper tread portion to an edge of the lower tread portion wherein the non-planar nose portion has an inner surface preformed in a concave shape for fitting over the nose of the stair tread, wherein the inner surface is formed by milling the nose portion of a solid wood piece comprising both the tread portion and the nose portion; and b. a planar riser overlay for fitting over the riser.

6. The overlay of claim 5, wherein the solid wood piece can be formed of two or more separate pieces of wood mounted to one another.

7. An improved resurfaced stair having a wooden tread with a rounded nose and a wooden riser, the improvement comprising a single-piece solid wood stair tread overlay having an upper planar tread portion, a lower planar tread portion, and a rounded rigid nose portion extending from the upper planar tread portion to the lower planar tread portion wherein the rounded nose portion has an inner surface preformed in a concave shape, wherein the inner surface is formed by milling the nose portion of a solid wood piece comprising both the tread portion and the nose portion, the tread overlay covering an exterior surface of the wooden tread, and a solid wood, planar riser overlay covering an exterior surface of the wooden riser.

8. The overlay of claim 7, wherein the solid wood piece can be formed of two or more separate pieces of wood mounted to one another.

9. A single-piece solid wood stair tread overlay for fitting over an open-ended stair tread having a first side with a first nose with an arcuate outer surface, a second side adjoining the first side with a second nose with an arcuate outer surface adjoining the first nose, and a third side adjoining the second side with a third nose with an arcuate outer surface adjoining the second nose, the tread overlay comprising an elongated planar tread portion for fitting over a planar portion of the stair tread and a first non-planar nose portion extending from a first edge of the tread portion with a first inner surface preformed in a concave shape configured to fit over the first nose of the stair tread, a second non-planar nose portion extending from a second edge of the tread portion with a second inner surface preformed in a concave shape configured to fit over the second nose of the stair tread, and a third non-planar nose portion extending from a third edge of the tread portion with a third inner surface preformed in a concave shape configured to fit over the third nose of the stair tread, wherein the preformed inner surface of the first nose portion, the second no portion and the third nose portion are formed by milling the nose portions of a solid piece of wood comprising both the tread portion and the nose portions.

10. A method for installing a single-piece stair tread overlay having an upper planar tread overlay portion, a lower planar tread overlay portion and a non-planar rigid nose portion with an inner surface preformed in a concave shape, wherein the inner surface is formed by milling the nose portion of a solid wood piece comprising both the tread portion and the nose portion, on a stair tread having an upper planar tread portion, a lower planar tread portion and non-planar nose portion, the method comprising:

a. measuring the dimensions of the stair tread;

b. cutting the upper planar tread overlay portion to an appropriate size; and c. mounting the nose portion of the tread overlay over the nose portion of the stair tread, mounting the upper planar tread overlay portion over the upper planar tread portion, and mounting the lower planar tread overlay portion under the lower planar tread portion.

11. The method of claim 10, wherein the solid wood piece can be formed of two or more separate pieces of wood mounted to one another.

12. A single-niece solid wood stair tread overlay having a substantially planar top tread portion configured to fit over a portion of the top surface of a stair tread, a rigid nose portion configured to fit over the tread nose, the nose portion having an elongated preformed concave inner channel for receiving the stair tread nose, wherein the elongated inner channel preformed in a concave shape for receiving the stair tread nose, wherein the elongated preformed concave inner channel is formed by milling the nose portion of a solid wood piece comprising both the tread portion and the nose portion; and a substantially planar bottom tread portion configured to fit over a portion of the lower surface of the stair tread.

13. The overlay of claim 12, wherein the solid wood piece can be formed of two or more separate pieces of wood mounted to one another.

14. A single-piece stair tread overlay having a rigid nose portion with an inner surface preformed in a concave shape for fitting over a stair tread having a nose, wherein the preformed concave inner surface is formed by milling the nose portion of a solid wood piece comprising both the tread portion and the nose portion, the stair tread overlay having an upper horizontal segment and lower horizontal segment that are spaced apart from one another, wherein the upper horizontal segment mates with an upper horizontal surface of, the stair tread and the lower horizontal segment of the stair tread overlay mates with a lower horizontal surface of the stair tread.

15. The overlay of claim 14, wherein the solid wood piece can be formed of two or more separate pieces of wood mounted to one another.

* * * * *